US006129618A

United States Patent [19]

Frech

[11] Patent Number: 6,129,618

[45] Date of Patent: Oct. 10, 2000

[54] OSCILLATING SANDER

[75] Inventor: Alfred Frech, Leinfelden-Echterdingen, Germany

[73] Assignee: Robert Bosch GmbH, Stuttgart, Germany

[21] Appl. No.: 09/230,819

[22] PCT Filed: Jun. 19, 1997

[86] PCT No.: PCT/DE97/01255

§ 371 Date: May 24, 1999

§ 102(e) Date: May 24, 1999

[87] PCT Pub. No.: WO98/06539

PCT Pub. Date: Feb. 19, 1998

[30] Foreign Application Priority Data

Aug. 9, 1996 [DE] Germany ..... 196 32 218

[51] Int. Cl.[7] ..... B24B 23/00; B24B 27/08

[52] U.S. Cl. ..... 451/357; 451/441; 451/344

[58] Field of Search ..... 451/344, 350, 451/353, 357, 359, 360, 294, 378, 386, 391, 441, 400; 74/86

[56] References Cited

U.S. PATENT DOCUMENTS 2,786,313 3/1957 Shaff .
5,398,454 3/1995 Berner ..... 451/357
5,496,207 3/1996 Hornung et al. ..... 451/357
5,626,510 5/1997 Bergner et al. ..... 451/357
5,888,128 3/1999 Lamprecht et al. ..... 451/357

FOREIGN PATENT DOCUMENTS 0 610 801 8/1994 European Pat. Off. .
93 20 393 6/1994 Germany .

*Primary Examiner*—Derris Holt Banks
*Attorney, Agent, or Firm*—Kenyon & Kenyon

[57] ABSTRACT

An oscillating sander includes a housing and a tool holder which receives a sanding plate and sits via a rotary bearing on a rotating eccentric stem that projects from the housing and is attached flexibly against rotary entrainment on the housing by way of at least one oscillating, element. The oscillating is assembled from two hard-elastic rings, one outer ring and one inner ring, made in particular of plastic and arranged spaced apart from one another and in particular concentrically, which are coupled to one another, with minimally limited radial displaceability with respect to one another and with limited rotatability with respect to one another, via an elastic spacer element, the spacer element being made of soft plastic equipped with openings.

25 Claims, 6 Drawing Sheets

OSCILLATING SANDER

FIELD OF THE INVENTION

The present invention relates to an oscillating sander and to an oscillating element of the oscillating sander.

BACKGROUND INFORMATION

European Patent Application No. 0 610 801 describes a conventional oscillating sander of the species whose tool holder is coupled onto the housing via a flexible oscillating element, the known oscillating elements being of elongated T-shaped configuration, and being respectively attached with their long, rod-shaped center web to the tool holder, and standing out at right angles therefrom and resting positively in recesses of the housing.

Because of the elongated shape of the known oscillating elements, the spacing of the tool holder from the housing is so great that the device is relatively less than compact, and the operator's hand is relatively far away from the workpiece being processed, so that it is thus difficult to process sensitively.

SUMMARY OF THE INVENTION

A oscillating sander according to the present invention has the advantage that as a result of the disk-shaped configuration, according to the present invention, of the oscillating element, the spacing between the tool holder and the housing can be kept considerably smaller than in the previously known art. The bearing spacings between the housing and the tool holder for the output shaft can accordingly also be kept small. The tilting moment acting on the bearings is consequently minimized, so that the output shaft can be made smaller and lighter.

The oscillating sander can thus be handled more sensitively, and workpieces can be processed particularly accurately with it.

The oscillating element according to the present invention meets, the need for minimum possible rotatability of the tool holder or tool with respect to the housing, along with a particularly smooth-running, minimally limited orbital oscillating motion of the tool holder with the tool during sanding operations. This ensures effective material removal when sanding in poorly accessible corners and flutes if the tool is applied especially firmly or at a tilt onto the workpiece, and reduces the load on the rotary bearings.

The oscillating element according to the present invention provides a compact and flat design for the oscillating sander, and excludes from the housing and from the lower bearing of the working shaft any sanding dust arriving from below. The oscillating element according to the present invention can moreover be mounted particularly easily on the oscillating sander by axially inserting the parts into one.

SUMMARY OF THE INVENTION

Because the oscillating element includes an outer ring and an inner ring, which are joined to one another by a spacer element made up of spoke-like ribs running obliquely with respect to a radial line, particularly hard limits are placed on rotation of the sanding plate with respect to the housing, the eccentric motion being guided and cushioned especially softly. This reduces the load on the working shaft bearings. According to, another exemplary embodiment of the prsent invention because, the spacer element is made of a rubber-like, injectable soft plastic with regular openings, certain regions of the spacer element can, upon deformation as a result of rotation of the tool with respect to the housing, enter into the deflection spaces thus created, thereby achieving a controlled spring characteristic similar to that with spoke-like ribs.

In addition, the openings in the spacer element result in the formation of correspondingly dimensioned and oriented ribs with which the different spring characteristic of the spacer element can be even better defined between hard rotational delimitation and soft radial delimitation.

Because the inner ring has lobes projecting radially outward, and the outer ring has counterlobes pointing radially inward and overlapping the lobes, the rotatability of the inner ring with respect to the outer ring is delimited by positive engagement; the spacer element is immobilized between the lobes and counterlobes and can be compressed en bloc by rotation of the outer ring with respect to the inner ring, for example by rotation of the tool with respect to the housing, thereby limiting the rotation of the rings with respect to one another so that overloading of or damage to the spacer element can be prevented.

Because the oscillating element is a replaceable spare part that, by way of its configuration, critically influences the function of the oscillating sander, this part has a distinct inventive significance.

DETAILED DESCRIPTION

Figure 1:
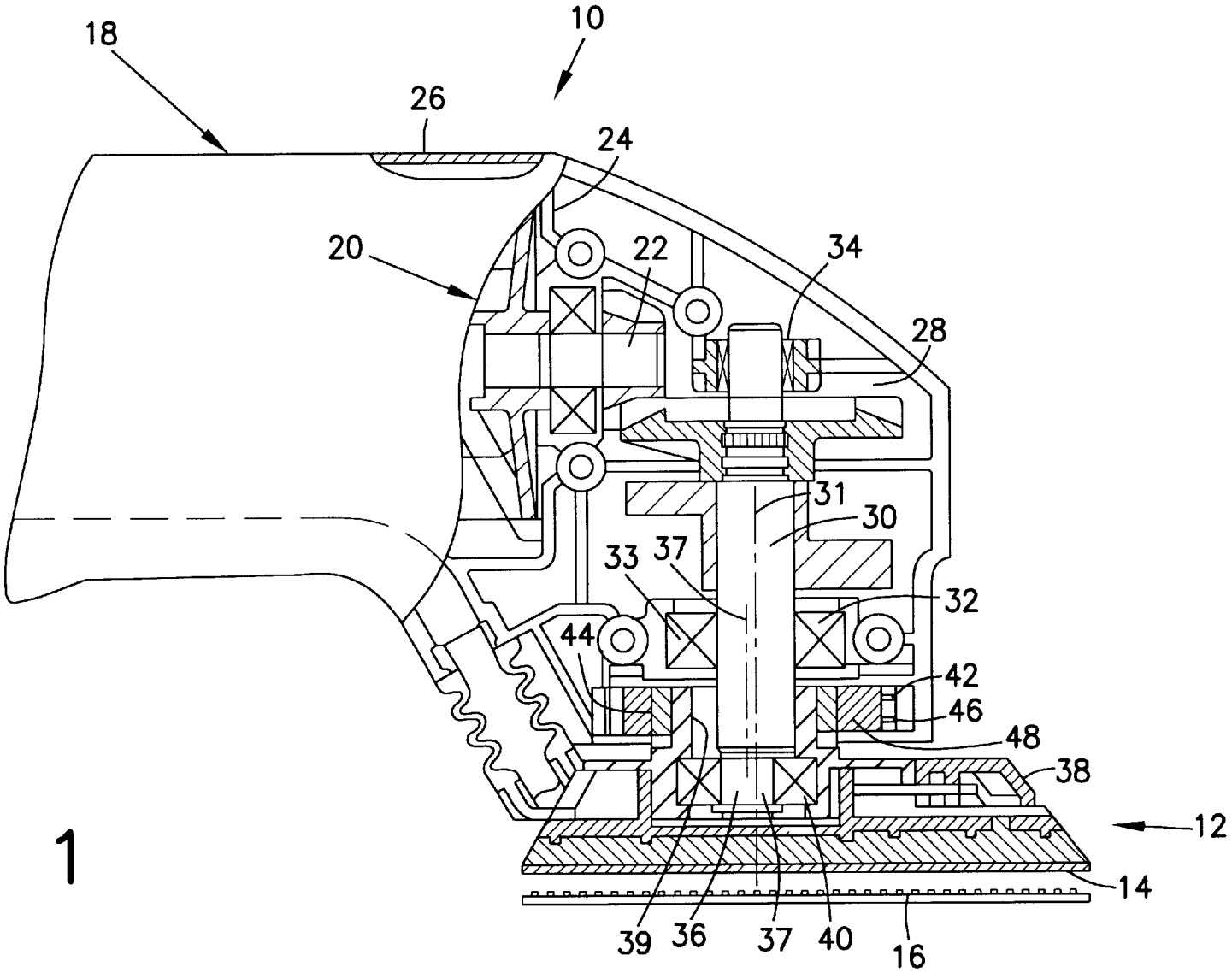
FIG. 1 shows a partial longitudinal section of a front region of a oscillating sander according to the present invention.

Oscillating sander 10 shown in partial longitudinal section in FIG. 1 is configured as a delta sander, and has a triangular, symmetrical sanding plate 12. Sanding plate 12 is made of plastic, and its underside is equipped with a hook-and-loop pad 14 for receiving a sandpaper sheet 14. Delta sander 10 can selectably be fitted with a conventional rectangular sanding plate known per se, with a round sanding disk, or with other sanding tools, for example a flap-wheel sanding attachment or a sanding tongue or sanding roller.

Delta sander 10 possesses a housing 18 which carries an electric motor 20, of which only a fan 24 sitting on its output shaft 22 is visible in FIG. 1. A slide switch 26 arranged on the upper side of housing 18 serves to switch electric motor 20 on and off. Output shaft 22 drives, via a right-angle drive train 28, a working shaft 30 which is rotatably mounted in two housing-mounted ball bearings 32 and 33, and projects out of housing 18, from the lower end face of housing 18, with an eccentric stem 36. Sitting on eccentric stem 36 is a tool holder 38 which carries a pressed-in ball bearing 21 and on its underside nonrotatably and axially nondisplaceably receives sanding plate 12. Tool holder 38 and sanding plate 12 are matched to one another in terms of shape, so that sanding plate 12 rests in planar fashion against tool holder 38. Tool holder 38 is fastened via a flexible oscillating element 42 to housing 18, and thus protected from being rotationally entrained by the rotating eccentric stem 36.

When electric motor 20 is switched on using slide switch 26, the motor drives working shaft 30, via right-angle drive train 28, so that it rotates about its axis 31. Eccentric stem 36, whose axis 37 is offset from axis 31 of working shaft 30 by a distance equal to eccentric dimension e, performs a circular motion as working shaft 30 rotates, thus imparting to tool holder 38, together with sanding plate 12 and sandpaper sheet 16, an orbiting motion in which it is prevented by oscillating element 42 from rotating about its own axis.

Oscillating element 42, which is depicted in detail in FIGS. 2 through 8, is configured as a ring which fits with its radially internally located region around tool holder 38, and whose radially externally located region is attachably encompassed by housing 18. Oscillating element 42 has an inner ring 44 and an outer ring 46 spaced apart concentrically therefrom, as well as an annular spacer element 48 made of flexible material, for example silicone. This spacer element 48 joins the inner 44 and outer ring 46 to one another. Inner ring 44 and outer ring 46 are made of plastic, and annular spacer element 48 is manufactured from rubber or from an injectable soft plastic. Silicone has particularly temperature-stable characteristics.

Figure 2:
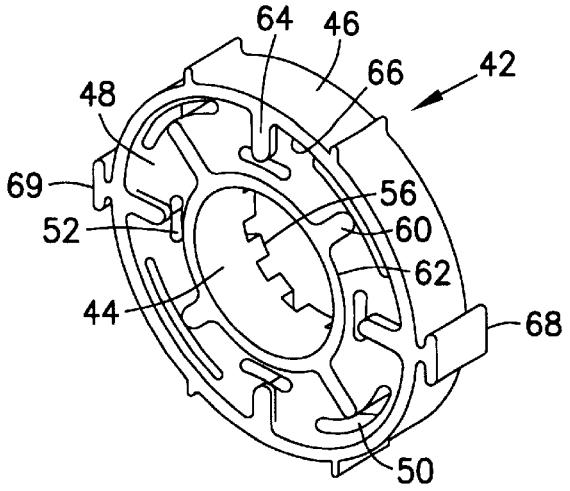
FIG. 2 shows a perspective view of the oscillating element illustrated in FIG. 1.
Figure 3:
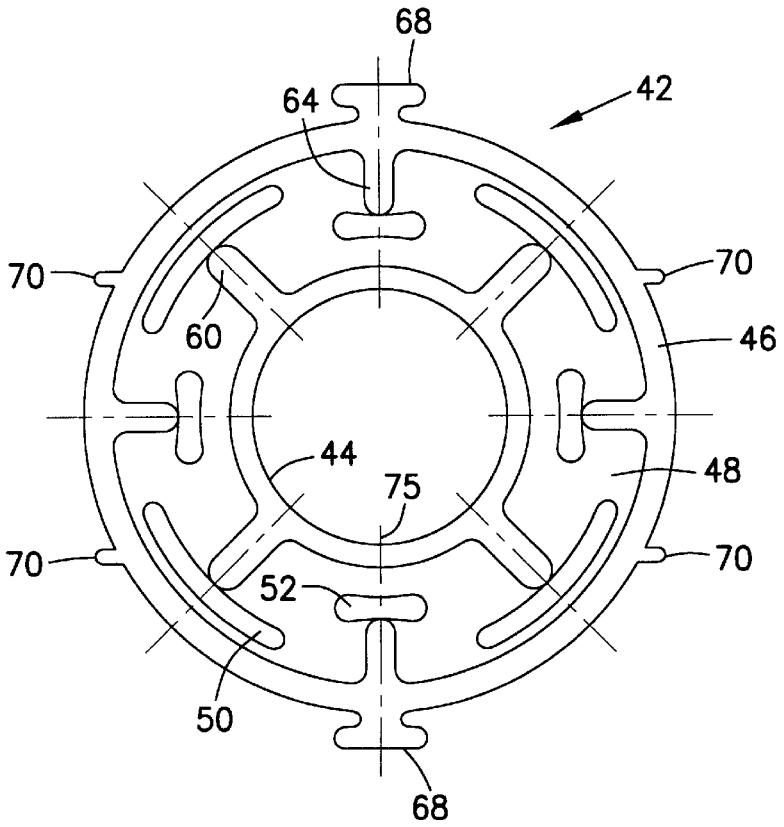
FIG. 3 shows a plan view of the oscillating element illustrated in FIG. 1 .

FIGS. 2 and 3 show the annular spacer element 48 with axially continuous slot-like openings 50 and 52 which pass through spacer element 48 uniformly, as if on a reference circle, radially farther inward and farther outward. Openings 50, 52 are each closely radially adjacent to four radially outward-facing lobes 60 of inner ring 44, and to four radially inward-facing counterlobes 64 of outer ring 46. Lobes 60 and counterlobes 64 overlap one another in the radial direction and engage, like a toothed hub or shaft, into tooth gap-like spaces 62 and 66 located respectively opposite them.

Inner ring 44 is attached on tool holder 38 coaxially with ball bearing 40, and outer ring 46 is held nonrotatably in housing 18 by positive engagement. For this purpose, outer ring 46 carries on its exterior, arranged in a manner distributed over the circumference, integral lugs 68, 70 which can be placed, in a manner secured against loss, into corresponding grooves 80, 81 arranged in housing 18. Of the six radial external lugs 68, 70 shown the two external lugs 68 located diametrically opposite one another are of T-shaped configuration, with their respective center webs 75 extending radially out from outer ring 46.

Inner ring 44 is slid onto an annular fitting 39 that is configured on the upper side of tool holder 38 coaxially with axis 37 of eccentric stem 36, and joined immovably thereto, for example welded or adhesively bonded. For accurate alignment of oscillating element 42 when being placed onto annular fitting 39, integrally shaped-on axial positioning lugs 56 (FIG. 2) are arranged, distributed over the circumference, on the lower end face of inner ring 44, and when oscillating element 42 is placed onto annular fitting 39 they enter positively into corresponding recesses on annular fitting 39 and create a positive connection which is secured against undesired detachment.

Inner ring 44 can also be axially joined to tool holder 38 in a different fashion, e.g. can be welded.

Figure 4:
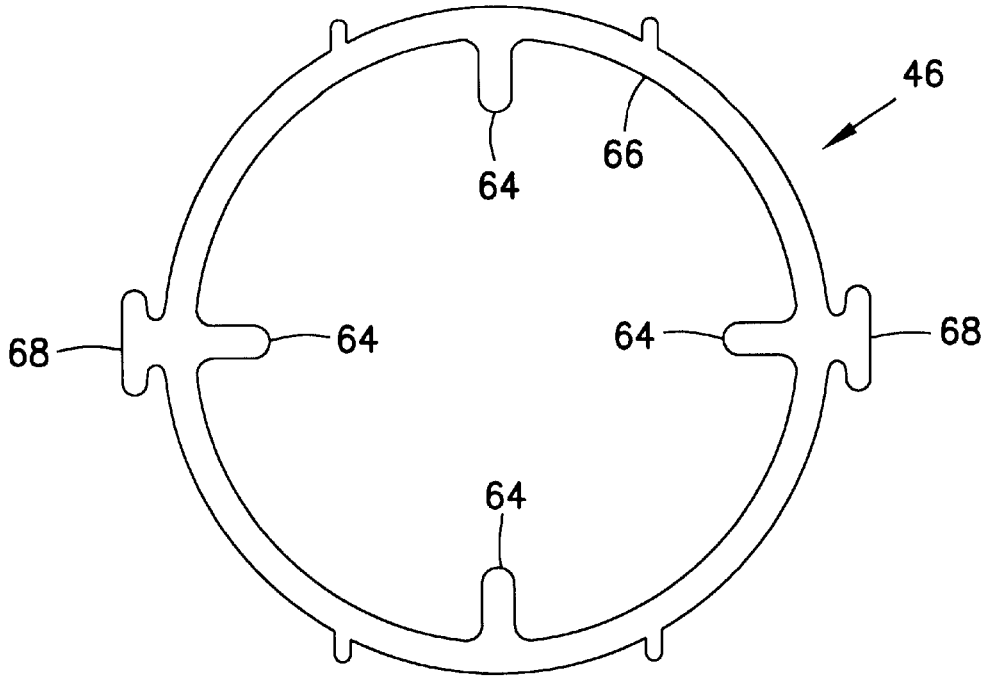
FIG. 4 shows an outer ring of the oscillating element illustrated in FIG. 3.

FIG. 4 shows a plan view of outer ring 46 of oscillating element 42, the radially inward-facing lobes 64, spaces 66, and radial external lugs 68 being clearly shown.

Figure 5:
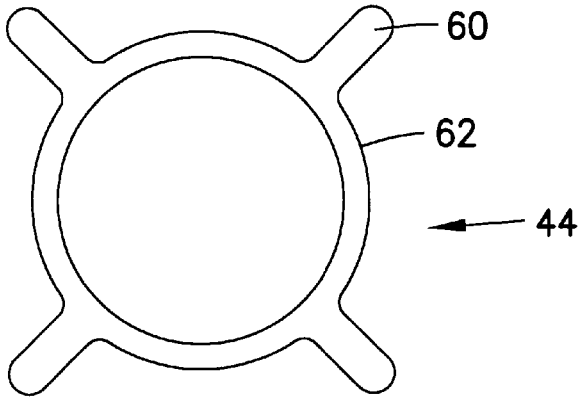
FIG. 5 shows a plan view of an inner ring of the oscillating element illustrated in FIG. 3.

FIG. 5 shows a plan view from below of inner ring 44 of oscillating element 42, with the four radially outward-facing lobes 60 and recesses 62.

Figure 6:
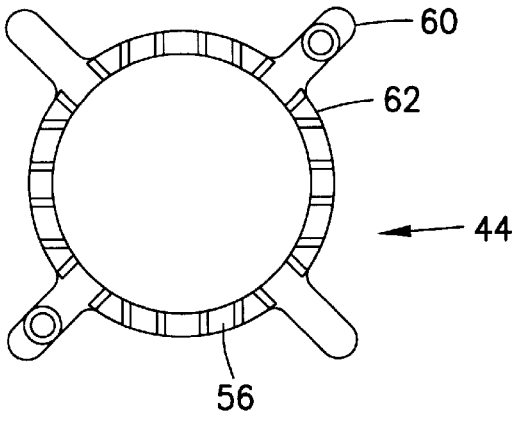
FIG. 6 shows a bottom view of the inner ring.

FIG. 6 shows inner ring 44 from below, indicating the axial positioning lugs 56 which positively and releasably define the position of oscillating element 42 with respect to tool holder 38.

Figure 7:
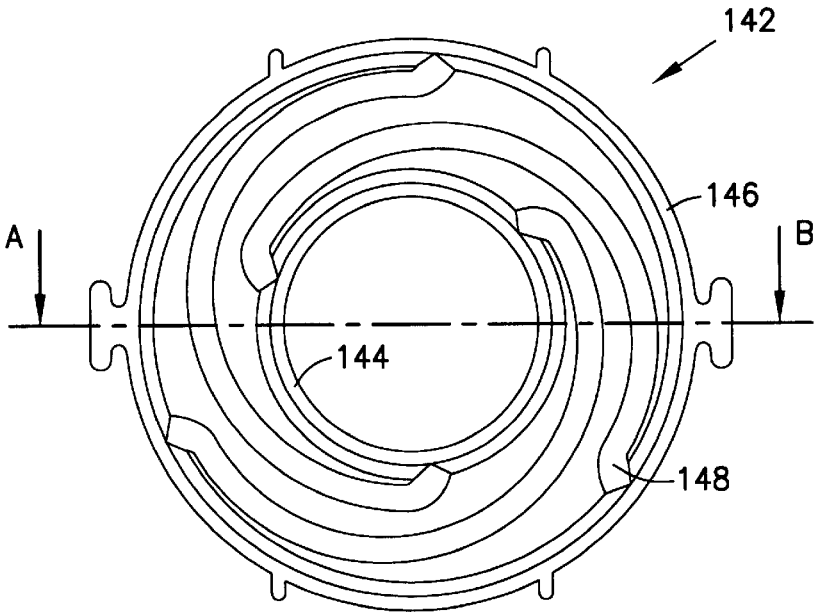
FIG. 7 shows a plan view of another exemplary embodiment of the oscillating element.

FIG. 7 shows a further exemplary embodiment of an oscillating element 142 which includes an outer ring 146 and an inner ring 144 that are joined to one another by spacer members, extending in obliquely curved fashion, in the form of three spokes 148.

Figure 8:
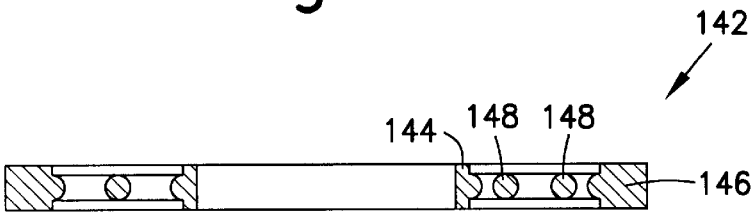
FIG. 8 shows a cross section of the oscillating element illustrated in FIG. 7.

FIG. 8 shows a cross section of oscillating element 142 according to FIG. 7; the cavities between the spoke-like spacer members 148 can be open or can be additionally filled by injection with silicone or the like.

Figure 9:
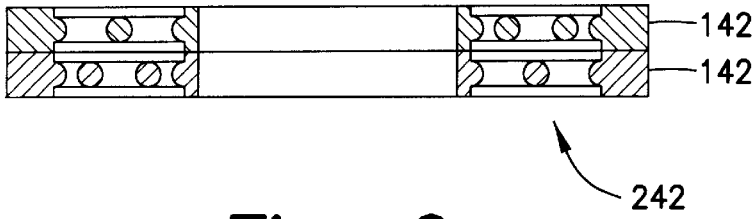
FIG. 9 shows a cross section of an oscillating element formed from a doubled arrangement of the oscillating element illustrated in FIG. 7.
Figure 10:
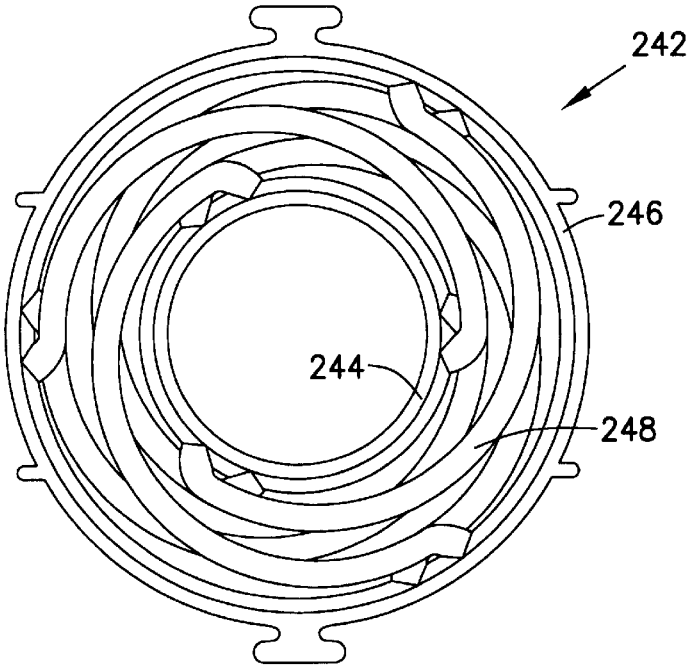
FIG. 10 shows a plan view of the oscillating element illustrated in FIG. 9.

FIGS. 9 and 10 show a further oscillating element 242, assembled from two oscillating elements 142 according to FIGS. 7 and 8, which secures inner ring 244 even more effectively against rotation with respect to outer ring 246.

FIG. 10 shows a plan view of oscillating element 242 according to FIG. 10, clearly indicating that spoke-like spacer members 148 run in opposite directions.

Figure 11:
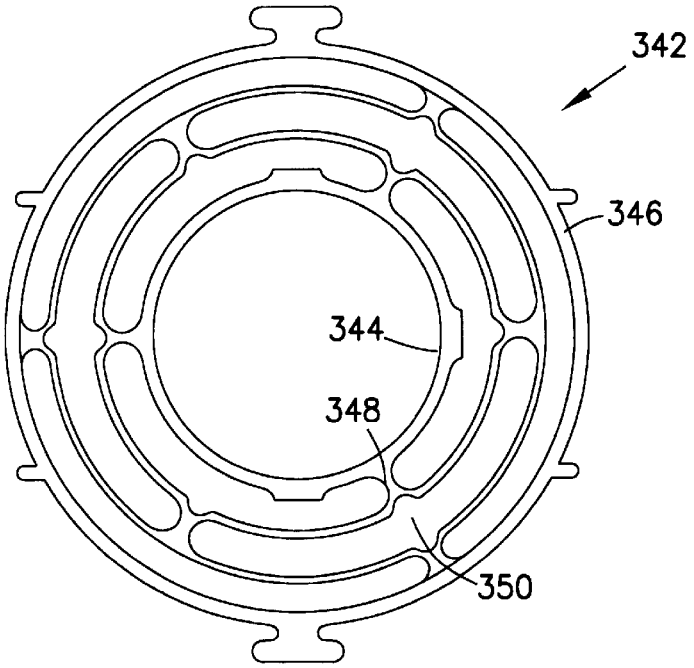
FIG. 11 shows another exemplary embodiment of the oscillating element.

FIG. 11 shows a further oscillating element 342, including outer ring 346 and inner ring 344, whose spacer member 348 possesses regular openings 350 extending in circular fashion, the arrangement of which imparts a particular spring characteristic to the remaining material of spacer element 348.

Figure 12:
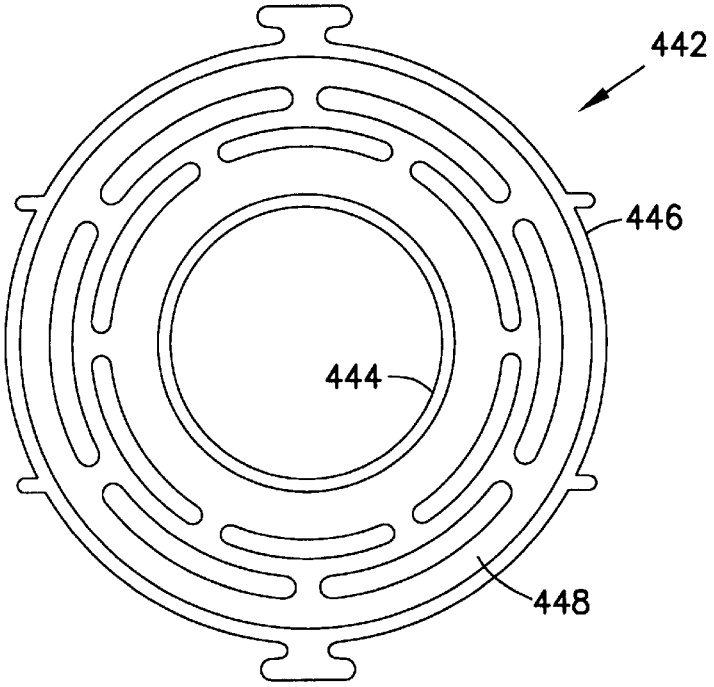
FIG. 12 shows a further exemplary embodiment of the oscillating element.

FIG. 12 shows an exemplary embodiment of an oscillating element 442 which is similar to ascillation element 342 shown in that according FIG. 11; openings 350 in spacer member 448 of oscillating element 442 are smaller than in spacer member 348 and have, regardless of the type of material chosen for spacer member 448, a different spring characteristic more suitable for certain applications.

In an exemplary embodiment of an oscillating element that is not depicted, two hard-elastic rings substantially of equal size, axially spaced apart and joined to one another by an elastic spacer ring which fills up the axial cavity, are provided, the lower ring being joinable to the tool holder and the upper ring to the housing of the oscillating sander. It is also possible, in this exemplary embodiment, to provide axially projecting lugs which overlap one another axially, lie on approximately the same circle diameter, and serve, when the rings rotate with respect to one another, as stops which limit rotation. The spring characteristic achievable therewith is of similar quality to that with the radially concentrically arranged outer and inner rings of the previously described exemplary embodiments.

What is claimed is:

1. An oscillating sander, comprising:

a housing;

a rotating eccentric stem projecting from the housing;

a rotary bearing;

a tool holder disposed on the rotating eccentric stem via the rotary bearing; and at least one oscillating element flexibly attaching the tool holder to the housing for preventing the tool holder from following a rotation of the rotating eccentric stem, the at least one oscillating element including an elastic spacer element and two hard-elastic rings composed of a plastic material, the elastic spacer element having openings, wherein a first of the hard-elastic rings is spaced at a predetermined distance from a second of the hard-elastic rings, the two hard-elastic rings being radially and displaceably coupled to one another via the elastic spacer element, and wherein the first hard-elastic ring is rotatable with respect to the second hard-elastic ring in a limited predetermined manner.

2. The oscillating sander according to claim 1, wherein the hard-elastic rings have a cavity therebetween, the cavity being filled in a flush manner by the elastic spacer element.

3. The oscillating sander according to claim 1, wherein the two hard-elastic rings are situated concentrically, the first hard-elastic ring being an outer ring and the second hard-elastic ring being an inner ring.

4. The oscillating sander according to claim 3, wherein the elastic spacer element is composed of an injectable soft plastic material, wherein the openings in the elastic spacer element have an elongated configuration and extend in a particular orientation which is perpendicular to radials, and wherein the at least one oscillating element includes ribs which are provided between the openings in the elastic spacer element, the ribs defining a first spring action in a circumferential direction and a second spring action in a radial direction, the first and second spring actions being defined between the outer ring and the inner ring.

5. The oscillating sander according to claim 3, wherein the inner ring includes radially outward-facing protruding lobes, the protruding lobes being provided at a first spacing from one another, wherein the outer ring includes radially inward-facing counterlobes, the counterlobes being provided at a second spacing from one another, and wherein the protruding lobes penetrate into the second spacing, and the counterlobes penetrate into the first spacing so that one of the protruding lobes and the counterlobes overlaps another one of the protruding lobes and the counterlobes.

6. The oscillating sander according to claim 5, wherein the elastic spacer element is immobilized between the protruding lobes and the counterlobes, the elastic spacer element being completely compressible by rotating the outer ring with respect to the inner ring for limiting a rotation of the hard-elastic rings with respect to one another.

7. The oscillating sander according to claim 6, wherein the elastic spacer element is compressed by rotating a tool received by the tool holder with respect to the housing.

8. The oscillating sander according to claim 1, wherein the tool holder receives a sanding plate.

9. The oscillating sander according to claim 1, wherein the hard-elastic rings are concentrically spaced apart from one another.

10. An oscillating sander, comprising:

a housing;

a rotating eccentric stem projecting from the housing;

a rotary bearing;

a tool holder disposed on the rotating eccentric stem via the rotary bearing; and at least one oscillating element flexibly attaching the tool holder to the housing for preventing the tool holder from following a rotation of the rotating eccentric stem, the at least one oscillating element including an elastic spacer element and two hard-elastic rings composed of a plastic material, the elastic spacer element including spoke-shaped ribs extending obliquely with respect to a radial direction of the hard-elastic rings, wherein a first of the hard-elastic rings is spaced a predetermined distance from a second of the hard-elastic rings, the hard-elastic rings being radially and displaceably coupled to one another via the elastic spacer element, and wherein the first hard-elastic ring is rotatable with respect to the second hard-elastic ring in a limited predetermined manner.

11. The oscillating sander according to claim 10, wherein the first hard-elastic ring is an outer ring and the second hard-elastic ring is an inner ring.

12. The oscillating sander according to claim 11, wherein the first and second hard-elastic rings are concentric.

13. The oscillating sander according to claim 10, wherein the tool holder receives a sanding plate.

14. An oscillating element of an oscillating sander, the oscillating sander including a housing, a rotating eccentric stem projecting from the housing, a rotary bearing, and a tool holder disposed on the rotating eccentric stem via the rotary bearing, the oscillating element flexibly attaching the tool holder to the housing for preventing the tool holder from following a rotation of the rotating eccentric stem, the oscillating element comprising:

an elastic spacer element having openings; and two hard-elastic rings composed of a plastic material, wherein a first of the hard-elastic rings is spaced at a predetermined distance from a second of the hard-elastic rings, the two hard-elastic rings being radially and displaceably coupled to one another via the elastic spacer element, and wherein the first hard-elastic ring is rotatable with respect to the second hard-elastic ring in a limited predetermined manner.

15. The oscillating element according to claim 14, wherein the two hard-elastic rings are situated concentrically, the first hard-elastic ring being an outer ring and the second hard-elastic ring being an inner ring.

16. The oscillating element according to claim 15, wherein the elastic spacer element is composed of an injectable soft plastic material, wherein the openings in the elastic spacer element have an elongated configuration and extend in a particular orientation which is perpendicular to radials, and wherein the at least one oscillating element includes ribs which are provided between the openings in the elastic spacer element, the ribs defining a first spring action in a circumferential direction and a second spring action in a radial direction, the first and second spring actions being defined between the outer ring and the inner ring.

17. The oscillating element according to claim 15, wherein the inner ring includes radially outward-facing protruding lobes, the protruding lobes being provided at a first spacing from one another, wherein the outer ring includes radially inward-facing counterlobes, the counterlobes being provided at a second spacing from one another, and wherein the protruding lobes penetrate into the second spacing, and the counterlobes penetrate into the first spacing so that one of the protruding lobes and the counterlobes overlaps another one of the protruding lobes and the counterlobes.

18. The oscillating element according to claim 17, wherein the elastic spacer element is immobilized between the protruding lobes and the counterlobes, the elastic spacer element being completely compressible by rotating of the outer ring with respect to the inner ring for limiting a rotation of the hard-elastic rings with respect to one another.

19. The oscillating element according to claim 14, wherein the first hard-elastic ring is an outer ring and the second hard-elastic ring is an inner ring.

20. The oscillating element according to claim 14, wherein the first and second hard-elastic rings are concentric.

21. The oscillating element according to claim 14, wherein the tool holder receives a sanding plate.

22. An oscillating element of an oscillating sander, the oscillating sander including a housing, a rotating eccentric stem projecting from the housing, a rotary bearing, and a tool holder disposed on the rotating eccentric stem via the rotary bearing, the oscillating element flexibly attaching the tool holder to the housing for preventing the tool holder from following a rotation of the rotating eccentric stem, the oscillating element comprising:

an elastic spacer element; and two hard-elastic rings composed of a plastic material, the elastic spacer element including spoke-shaped ribs extending obliquely with respect to a radial direction of the hard-elastic rings, wherein a first of the hard-elastic rings is spaced at a predetermined distance from a second of the hard-elastic rings, the hard-elastic rings being radially and displaceably coupled to one another via the elastic spacer element, and wherein the first hard-elastic ring is rotatable with respect to the second hard-elastic ring in a limited predetermined manner.

23. The oscillating element according to claim 22, wherein the first hard-elastic ring is an outer ring and the second hard-elastic ring is an inner ring.

24. The oscillating element according to claim 23, wherein the first and second hard-elastic rings are concentric.

25. The oscillating element according to claim 22, wherein the tool holder receives a sanding plate.

* * * * *

UNITED STATES PATENT AND TRADEMARK OFFICE

CERTIFICATE OF CORRECTION

PATENT NO. : 6,129,618
DATED : October 10, 2000
INVENTOR(S) : Alfred Frech

It is certified that error appears in the above-identified patent and that said Letters Patent is hereby corrected as shown below:

Abstract,
Line 5, change "... oscillating,...." to -- oscillating --.
Line 6, change "... oscillating ..." to -- oscillating element --.

Column 1,
Line 10, delete "of the species".
Line 40, change "... meets, ..." to -- meets --.
Line 54, change "... one." to -- one another. --.
Line 55, delete "SUMMARY OF THE INVENTION".
Line 64, indent the paragraph beginning with "According ...".

Column 3,
Line 57, change "Of the six ..." to -- Of six --.
Line 58, change "... shown ..." to -- shown, --.

Column 4,
Line 43, change "... ascillation ..." to -- oscillation --.
Line 44, change "... in that according FIG. 11;..." to -- in FIG. 11 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*